US005421856A

United States Patent [19]

Lazcano-Navarro

[11] Patent Number: 5,421,856

[45] Date of Patent: Jun. 6, 1995

[54] PROCESS TO REDUCE DROSS IN MOLTEN ALUMINUM

[76] Inventor: Arturo Lazcano-Navarro, Harold R. Pape #1811, Monclova, Coahuila, Mexico, 25750

[21] Appl. No.: 218,249

[22] Filed: Mar. 28, 1994

Related U.S. Application Data

[63] Continuation-in-part of Ser. No. 64,435, May 21, 1993, abandoned.

[51] Int. Cl.[6] ..... C22B 21/00

[52] U.S. Cl. ..... 75/672; 75/686; 75/687; 75/709; 266/901

[58] Field of Search ..... 75/672, 686, 687, 709; 266/901

[56] References Cited

U.S. PATENT DOCUMENTS 4,907,784 3/1990 Kusaka et al. ..... 266/901

5,211,744 5/1993 Areaux et al. ..... 75/594

*Primary Examiner*—Melvyn J. Andrews

*Attorney, Agent, or Firm*—Laurence R. Brown

[57] ABSTRACT

Dross formation in the aluminum melting and/or refining is avoided partially or totally by the method of this invention. The method is useful in unmodified open top furnaces. The elimination or reduction of dross formation is carried out throughout the body of molten aluminum by the installation of gas injection devices to extend through the refractory lining in the bottom of the furnace. For longer life without clogging metal cased refractories of the directional porosity type are used for gas injection. Mixtures of inert and hydrocarbon gases are used with respective proportions chosen to match the design parameters of different types of furnaces. In operation the dross is eliminated by reactions of the injected gases with the impurities of the molten aluminum batch at its hottest temperatures in the body of the aluminum mass to thereby reduce dross generally caused by oxidation of the molten aluminum within the molten mass. Furthermore the injected gases at a multiplicity of injection sites permeate the entire molten batch to eliminate dross formation accelerated by the high temperature of the molten aluminum. By continuous flow of the injected gases, the surface of the aluminum melt is dynamically kept free of oxygen that might form dross there without the necessity of using a closed top furnace with an atmosphere control system.

6 Claims, 2 Drawing Sheets

PROCESS TO REDUCE DROSS IN MOLTEN ALUMINUM

This application is a continuation-in-part of the application Ser. No. 08/064,435, filed May 21, 1993 for Process to Eliminate or Reduce the Dross Formation in Aluminum Melting and/or Refining, now abandoned.

TECHNICAL FIELD

This invention relates to melting and refining of aluminum and more particularly it relates to the reduction of dross formed in molten aluminum.

BACKGROUND ART

A very important aspect in the production of aluminum metal has not been mastered, namely preventing the formation of dross in molten aluminum. Due to its great affinity for oxygen, particularly at the higher temperature ranges reached in a furnace for melting or refining of aluminum, and on the surface where there is exposure to atmospheric oxygen, the metal returns to its oxide state forming dross. Dross is formed in the presence of even minor amounts of oxygen and this reaction is accelerated in the molten aluminum body in a furnace because of the high temperature. The aluminum oxide has higher melting temperature and lower specific gravity than molten aluminum; so aluminum furnace baths are normally covered with a layer of oxide solids. Skimming of this material from the bath invariably results in the coincidental removal of some of the underlying metal thus decreasing the potential yield.

Many efforts have failed to develop a method of converting this "secondary" aluminum oxide back to the metallic state once formed. Also, numerous attempts to develop a practice and economical method of recovering aluminum from this oxide material have been unsuccessful. Consequently, production of aluminum metal is accompanied by the formation of large quantities of aluminum dross as a waste product.

A recent attempt to resolve the dross problem in an aluminum furnace is set forth in U.S. Pat. No. 5,211,744, May 18, 1993 to L. A. Areaux, et al. for Method and Means for Improving Molten Metal Furnace Charging Efficiency. Therein, the dross formation is reduced by reducing oxygen in a trapped atmospheric blanket on the surface of the melt within a closed top furnace having a vacuum decontamination system removing gases from the aluminum surface. Inert gases are either produced by contaminants in the melt or introduced by an inert gas injector at or near the surface at the coolest point in the melt.

However this solution does not prevent formation of dross within the hottest molten aluminum region of the furnace where the formation of dross is accelerated, and furthermore requires an expensive and limited purpose special furnace with a vacuum operated decontamination system.

It is therefore an object of this invention to provide a feasible and low cost method to reduce dross formation in an aluminum furnace with the consequent great economical benefits in handling, dross processing and environmental problems.

Another object of the invention is to provide a method of reducing dross formation in an open top aluminum furnace in the absence of an atmosphere controlled decontamination system at the surface of the molten aluminum.

A still further object of the invention is to provide a more efficient and complete method of dross elimination in molten aluminum than heretofore available in the art.

DESCRIPTION OF THE INVENTION

Figure 1:
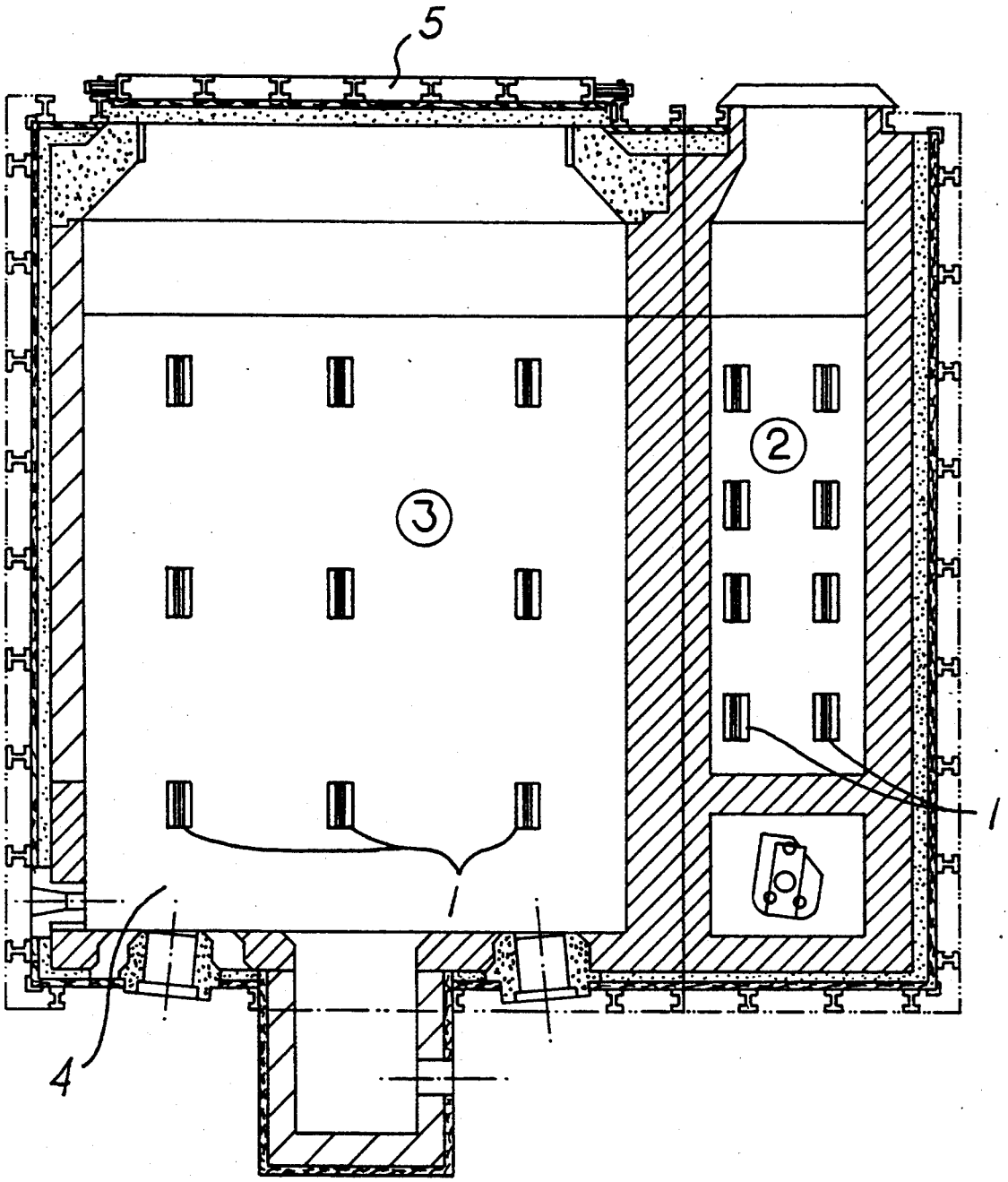
FIG. 1 schematically shows a plan view, in section, looking into an open top furnace to view two sets of gas injection elements extending through the bottom, and FIG. 2 schematically shows a fragmental view, partly in cross section, of an open top furnace with an arrangement of the injection elements extending through the bottom of the charge well and metal bath furnace sections.
Figure 2:
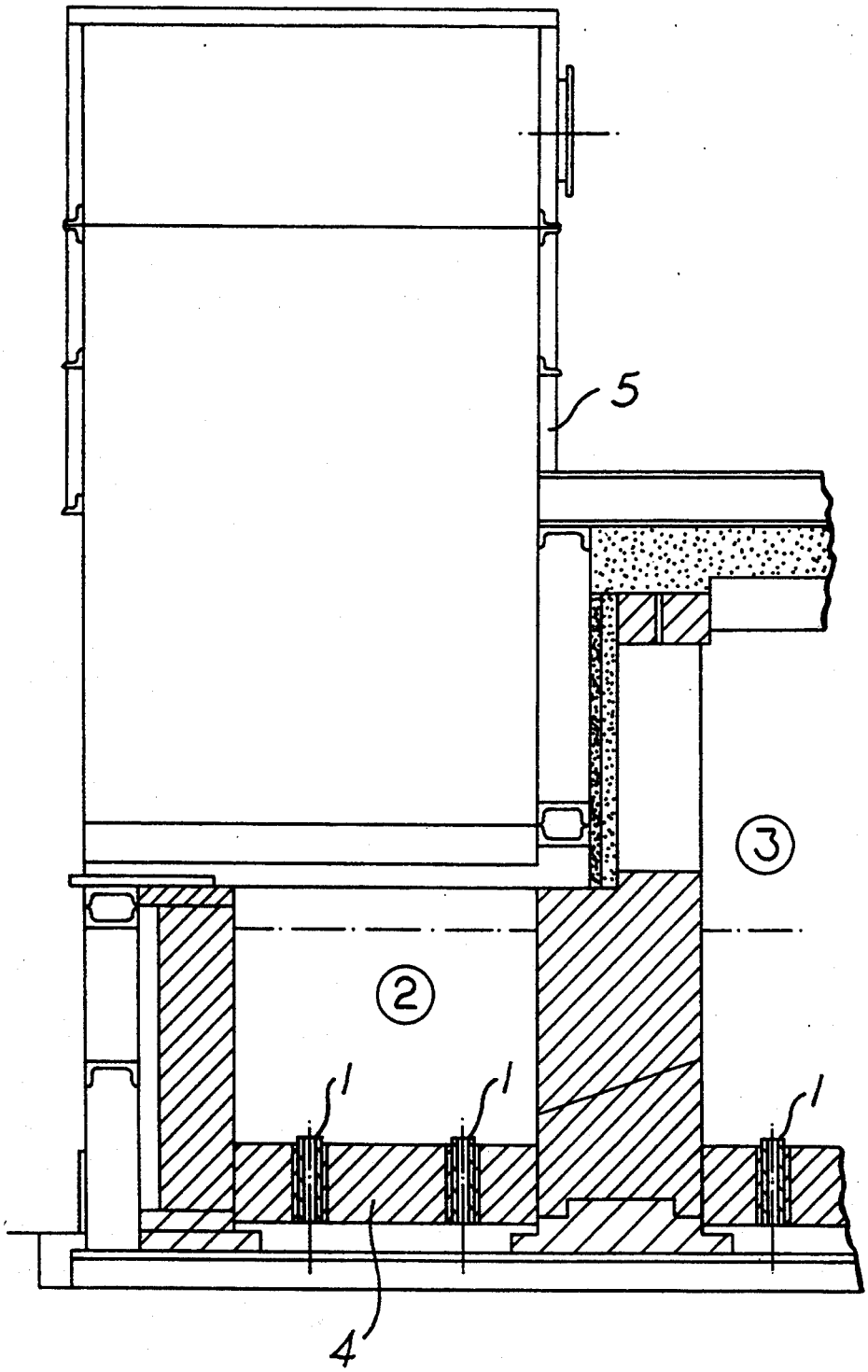

Referring to FIGS. 1 and 2, the gas injection devices 1 of metal cased refractories of the directional porosity type are secured in the refractory bottom 4 of the furnace 5. The number and locations of the gas injection devices 1 depends on the size and design of each particular furnace. The directional porosity type of gas injectors extending into the molten aluminum bath are advantageous for long life without clogging. Tuyeres or other types of porous injectors may be used. These injectors are available commercially since they have been used extensively in the steel industry. The installation in the furnace bottom is achieved in the same manner as formerly installed into steel furnaces.

The furnace 5 shown herein is particularly adapted to melt and refine aluminum and has a section 2 operable as a charge well for receiving an melting new charges of aluminum ore and the like. The section 3 is the aluminum refining furnace section which processes the aluminum melt. In this way, newly inserted charges of raw aluminum are separated from the main melt section 3.

The gas injection devices 1 as secured in the bottom 4 of the respective charge 2 and melt 3 sections of the furnace (5), have different spacing densities since the potential oxidation is different. Thus, the propensity to oxidize and form dross in the charge section 2 is greater, and has more gas injectors per unit area of the bottom.

The gas injected composition is a mixture of inert gases like argon or nitrogen with hydrocarbons like butane, propane, methane, etc. The concentration of the gas depends on the degree of potential oxidation, as illustrated for the two furnace sections 2, 3. The injected gas reaches substantially the entire molten body of the aluminum and particularly the higher temperature portions of the furnace where oxidation is accelerated in the absence of the injected gas. The inert gases result in the stirring of the molten body.

Gas injection is maintained continuously to avoid contamination of the injection elements and to provide a flow of injected gas from the top surface of the molten aluminum. For areas (such as the charging chamber 2) where the potential oxidation is higher, the higher will be the percentage of hydrocarbons in the molten body. This may come in part by the mixture of gases in the injection devices 1 as well as by the location and number of the injection devices 1. The hydrocarbons serve as a reducing agent, burning and consuming oxygen, both in the molten bath and at the surface so that surface oxidation from the atmosphere at the open top is reduced as well as the more extensive accelerated oxidation that forms dross in the higher temperature regions of the melt.

This invention provides an improved method of reducing dross formation in a molten aluminum metal bath contained in an open top furnace exposed to the atmosphere is provided by introducing an appropriate mixture of inert and hydrocarbon gases continuously into the furnace bottom to reduce the dross formation throughout the melt as well as on the surface where the gases exit. Accordingly those features of novelty identifying the nature and spirit of the invention are set forth with particularity in the following claims.

I claim:

1. A process to reduce dross formation in aluminum melting and/or refining in furnaces having a furnace bottom for melting and refining of aluminum, comprising the steps of:

maintaining molten aluminum in a furnace, and continuously injecting a mixture of inert and reducing agent hydrocarbon gases into the furnace bottom sufficient to reduce oxygen and the accompanying formation of dross in the molten aluminum throughout the furnace.

2. The process of claim 1, further comprising the step of establishing a concentration of hydrocarbon gas in said mixture as a function of the temperature of the molten aluminum.

3. The process of claim 1 further comprising the steps of:

providing an open top, closed bottom, furnace with separated charge and melt sections each having a bottom, and introducing in the bottom of each of the separate furnace sections a plurality of gas injector devices for introducing said gas mixture with more injector devices per unit of bottom area in the charge section.

4. The process of claim 1 further comprising the steps of: selecting an open top furnace subjecting a top surface of molten aluminum to the atmosphere having an oxygen component, and introducing a gaseous mixture with sufficient hydrocarbon to pass through the top surface and burn oxygen at the interface between the atmosphere and the molten aluminum.

5. The process of claim 1 further comprising the steps of: selecting an open top-closed bottom furnace subjecting a top surface of molten aluminum to the atmosphere, installing gas injection devices in the closed bottom of said furnace, and introducing said gas mixture into the molten aluminum through said gas injection devices thereby to pass the gases through the entire mass of molten aluminum in the furnace.

6. The process of claim 5 further comprising the step of installing said gas injection devices having a directional porosity characteristic.

* * * * *